US007294053B2

(12) United States Patent
Williams

(10) Patent No.: US 7,294,053 B2
(45) Date of Patent: Nov. 13, 2007

(54) PRESCRIPTION PAPER FOR PHYSICIANS

(76) Inventor: Brian A. Williams, 365 Camino Norte, Palm Springs, CA (US) 92262

( * ) Notice: Subject to any disclaimer, the term of this patent is extended or adjusted under 35 U.S.C. 154(b) by 0 days.

(21) Appl. No.: 10/925,717

(22) Filed: Aug. 24, 2004

(65) Prior Publication Data

US 2005/0032561 A1 Feb. 10, 2005

Related U.S. Application Data

(63) Continuation of application No. 10/117,865, filed on Apr. 4, 2002, now Pat. No. 6,779,816.

(60) Provisional application No. 60/281,688, filed on Apr. 4, 2001.

(51) Int. Cl.
*B41L 1/22* (2006.01)
*B42D 15/00* (2006.01)

(52) U.S. Cl. ..... 462/67; 462/84; 283/81

(58) Field of Classification Search ..... 283/61, 283/62, 67, 115, 900; 462/66, 69, 84, 18, 462/22, 25, 56, 67, 2, 8, 7, 17, 19, 23
See application file for complete search history.

(56) References Cited

U.S. PATENT DOCUMENTS 3,625,547 A 12/1971 Burke
3,912,305 A 10/1975 Fischer
4,021,060 A 5/1977 Seeley et al.
4,029,341 A * 6/1977 Neill et al. ..... 462/56
4,159,129 A * 6/1979 Lockhart ..... 462/67
4,277,089 A 7/1981 Lockhart
4,295,664 A * 10/1981 Cutting ..... 283/115
4,799,712 A * 1/1989 Biava et al. ..... 462/67
4,932,682 A 6/1990 Miller
4,941,685 A * 7/1990 Anderson ..... 462/67
4,949,998 A 8/1990 McFann et al.
5,048,870 A 9/1991 Mangini et al.
5,102,371 A 4/1992 Hanauer
5,135,437 A * 8/1992 Schubert ..... 462/8
5,154,668 A * 10/1992 Schubert ..... 462/25
5,248,280 A 9/1993 Lockwood et al.
5,352,155 A * 10/1994 Fahey ..... 462/25
5,393,100 A 2/1995 Coe
5,547,227 A 8/1996 Laurash et al.
5,704,648 A 1/1998 Brown et al.
5,752,723 A 5/1998 Robertson
5,791,691 A * 8/1998 Charles, Jr. ..... 283/66.1
6,135,507 A 10/2000 Hamby et al.
6,149,518 A * 11/2000 Farrow ..... 462/27
6,155,603 A 12/2000 Fox
6,779,816 B2 * 8/2004 Williams ..... 283/115

* cited by examiner

*Primary Examiner*—Dana Ross
(74) *Attorney, Agent, or Firm*—Knobbe, Martens, Olson & Bear LLP

(57) ABSTRACT

A prescription paper has reproduction material placed on selected areas of the back side of the paper so that prescription information can be transferred directly onto the patient's records while the prescription writer is writing the prescription. The reproduction material can be a carbonized backing or any other suitable reproduction material. The front side of the prescription paper comprises at least two lines that are separated by a pre-selected distance to match the distance between adjacent lines on the medical record. The prescription writer can align the lines on the prescription paper to the lines on the medical record so that information can be neatly transferred to the space between the lines on the medical record.

8 Claims, 3 Drawing Sheets

PRESCRIPTION PAPER FOR PHYSICIANS

RELATED APPLICATION

This application is a continuation of application Ser. No. 10/117,865, now U.S. Pat. No. 6,779,816 filed Apr. 4, 2002, which claims the benefit of U.S. Provisional Application No. 60/281,688 filed Apr. 4, 2001, which are hereby incorporated by reference in their entirety.

BACKGROUND OF THE INVENTION

1. Field of the Invention

This invention relates to note pads for physicians and other health care professionals, and more particularly to prescription papers that permit physicians and health care professionals to transfer prescription information onto a patient's chart in a convenient and cost efficient manner.

2. Description of the Related Art

Physicians and other health care professionals such as dentists and psychiatrists usually write drug prescriptions for their patients on small sheets of prescription paper. The prescription paper typically is not larger than 5 inches by 5 inches and can be purchased in pad form. Most prescription papers are preprinted with the doctor's name, address, DEA number and various other license numbers. Some also include designated areas for physicians to write the particular drugs prescribed, the dosage and refill information. After the doctor writes the prescribed medication on the prescription paper, the patient takes the prescription paper to a pharmacy where a pharmacist fills the prescription based on the doctor's instructions.

As customary practice, doctors typically have to transfer the prescription information, including the medication and dosage prescribed, to the patient's record to keep track of the treatment given. Some doctors rewrite the entire prescription on the patient's chart while others make a photocopy of the prescription paper and attach the copy to the patient's record. Since a typical doctor writes on an average of about 30 prescriptions per day, it becomes time consuming and costly for doctors to have to transfer the prescription information onto the patient's record each time a prescription is written.

In addition to prescribing medication, doctors often recommend to their patients non-prescription drugs by writing the information on note pad papers such as Post-It Notes®. Similar to prescription information, the doctor usually has to transfer the information given to the patient to the patient's chart for record keeping purposes. The task of rewriting such information onto the patient's chart would also consume the valuable time of the doctor and/or the staff.

To address this problem, prescription pads comprised of stacked sets of superimposed carbonless prescription papers have been developed. An exemplary prescription pad with stacked sets of carbonless prescription papers is disclosed in U.S. Pat. No. 5,248,280 to Lockwood. As illustrated in Lockwood, a carbonless copy is positioned underneath each sheet of prescription paper so that when a doctor writes the prescription information on the paper, the information is automatically transferred to the carbonless copy attached underneath. The patient then takes the original prescription paper to the pharmacy while the doctor retains the copy of the prescription for the patient's file. The prescription copy can be attached to the patient's chart via staples, paper clips, or the like. However, the prescription paper, typically being a small slip of paper, can easily become lost or misplaced in a patient's file which usually contains numerous pieces of paper of different sizes. Furthermore, while the doctor no longer has to rewrite the prescription information when using prescription papers such as those described in Lockwood, the doctor would still have to waste valuable time ensuring that the copy of the prescription paper is properly attached to the patient's chart or placed in the patient's records. It is also time consuming for a doctor to have to sort out the chronological sequence of medications prescribed when the prescriptions are written on numerous pieces of paper that are all clipped together to the patient's record. Furthermore, it can be even more problematic when the doctor forgets to place the copy of the prescription paper into the patient's file.

Thus, there is a need for an efficient and convenient way for doctors and health care providers to transfer prescription and non-prescription information given to patients onto patient's records without having to copy the information or having to attach extraneous pieces of paper to the patient's records.

SUMMARY OF THE INVENTION

In one aspect, the present invention provides a prescription sheet in combination with a medical record comprising a prescription sheet that is adapted to transfer prescription information directly onto the medical record while the information is being written onto the prescription sheet. The prescription sheet comprises a first and a second side with an area for writing a prescription which is lined with lines being a pre-selected distance apart formed on the first side. The prescription sheet further includes reproduction material positioned on the second side of the prescription sheet at a location corresponding to the area for writing the prescription. Furthermore, the medical record includes a patient history area that is also lined with lines being the pre-selected distance apart corresponding to the line separation of the prescription sheet such that the prescription writer can position the prescription sheet with lines of the medical records so that when the prescription writer writes the prescription, the reproduction material reproduces the prescription onto the medical record.

In another aspect, the present invention provides a method of simultaneously writing prescription and recording the prescription onto a medical record. The method comprises placing the prescription sheet onto the medical record such that the lines of a prescription area of the prescription sheet are substantially aligned with the lines of the medical record. The method further comprises writing the prescription in the prescription area while substantially maintaining the alignment between the prescription sheet, wherein writing the prescription area results in a reproduction material of the prescription sheet transferring the written information onto the medical record.

In yet another aspect, the present invention provides a prescription paper for a prescription writer to transfer prescription information directly onto a patient's record. The prescription paper comprises a front side having a selected area for the prescription writer to write down prescription information for patients. Preferably, the selected area comprises at least two adjacent lines separated by a pre-determined distance, the distance being selected to substantially match the distance between two adjacent lines located on the patient's record. The prescription paper further comprises a back side having a reproduction material. The reproduction material is adapted to be positioned on the patient's record in a manner such that the at least two lines on the selected area of the prescription paper aligns with the adjacent lines on the patient's record so that the production material transfers the prescription information directly onto the space between the adjacent lines on the patient's record while the prescription writer is writing down the prescription information.

DETAILED DESCRIPTION OF THE PREFERRED EMBODIMENT

The preferred embodiments of the present invention generally relate to prescription paper that permit doctors and other health care providers to transfer information from the prescription paper directly onto a patient's record without having to rewrite or make copies of the information.

Figure 1:
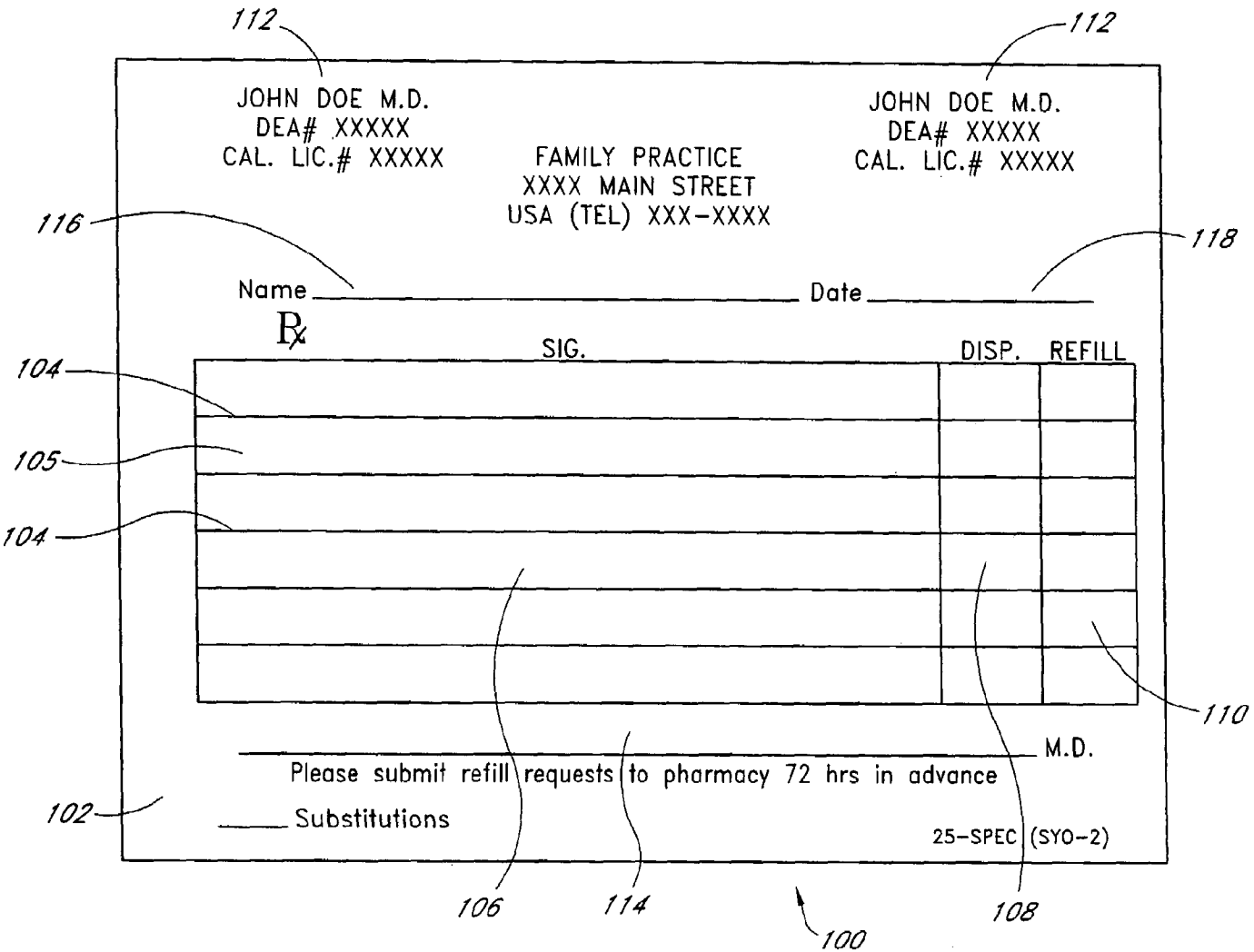
FIG. 1 illustrates a prescription paper of one preferred embodiment, showing the front side of the prescription paper.

References will now be made to the drawings wherein like numerals refer to like parts throughout. FIG. 1 shows a prescription paper 100 of one preferred embodiment of the present invention. As shown in FIG. 1, the prescription paper 100 has a front side 102 that is adapted for doctors and other health care providers to write prescription information thereto. The prescription information includes but is not limited to the name of drugs prescribed, drug dosage, and refill information. In one embodiment, the front side 102 of the paper 100 has a plurality of lines 104 for doctors to write down the prescription information. Preferably, there are sufficient lines for doctors to write down more than one prescription. Preferably, the space 105 between adjacent lines 104 are dimensioned to match the space between lines on a conventional patient chart so that the information can be neatly transferred onto the patient's record in a manner to be described in greater detail below. In one embodiment, the space 105 between adjacent lines 104 is about 5/16 inch. As shown in FIG. 1, the lines 104 many also include a first section 106 for the doctor to write down the specific drug prescription, a second section 108 for dosage information, and a third section 110 for refill information. Additionally, the front side 102 of the paper 100 may also include the physician's name 112, a place for the physician's signature 114, the patient's name 116 and the date 118.

Figure 2:
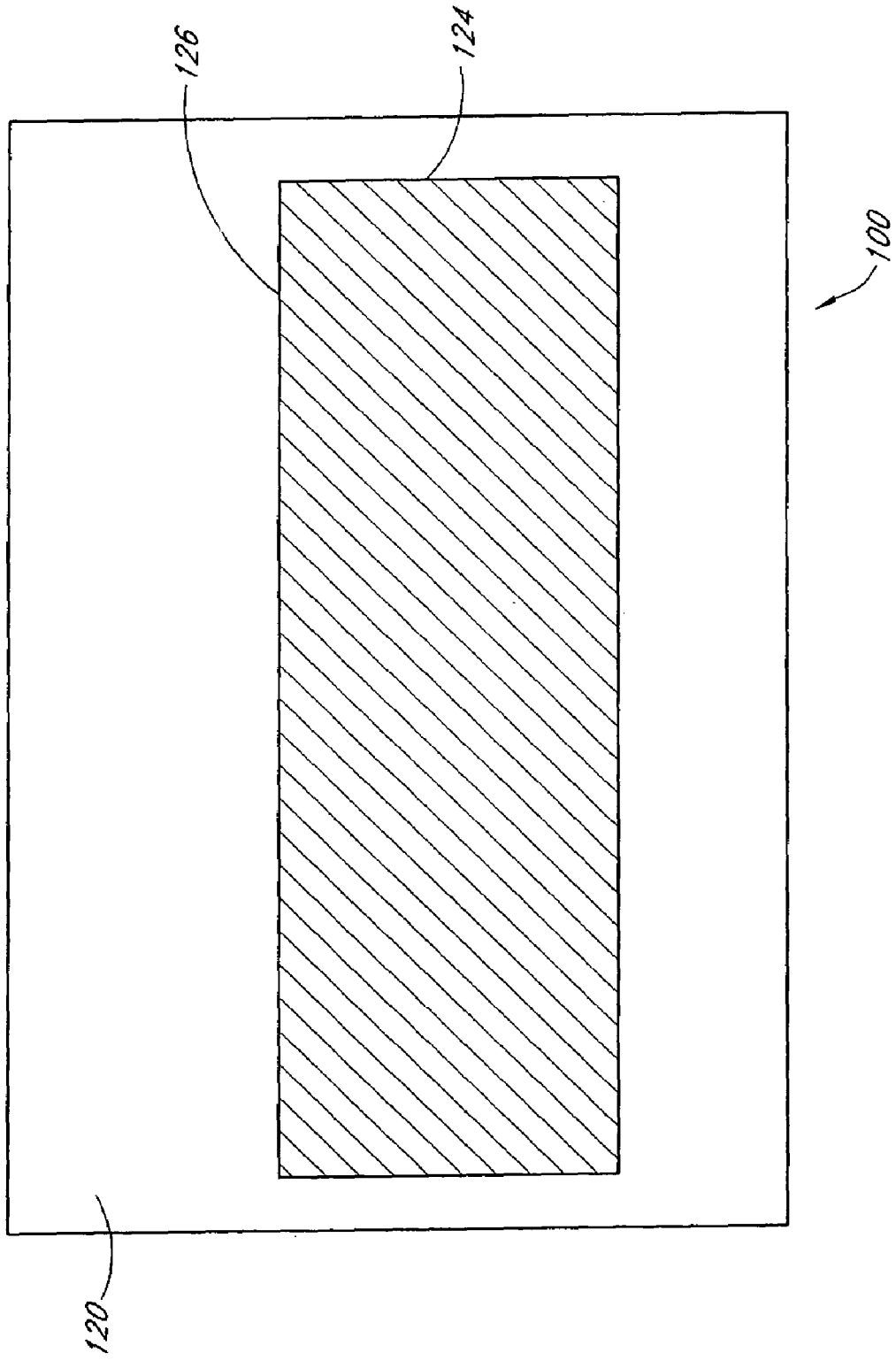
FIG. 2 illustrates the prescription paper of FIG. 1 showing the back side of the prescription paper.

FIG. 2 illustrates a back side 120 of the prescription paper 100. As shown in FIG. 2, the back side 120 comprises a carbonized backing 124 that is formed on a selected area 126 of the back side 120 of the prescription paper 100. Preferably, the carbonized backing 124 is positioned underneath the area on the front side 102 that contains the lines 104 for doctors to write down the prescription information. Preferably, the selected area 126 comprises the center portion of the paper and does not extend to the borders of the paper. In one embodiment, the carbonized backing 124 in the selected area 126 is less than about 70% of the area of the back side 120 of the prescription paper. In practice, the doctor places the carbonized backing 124 of the prescription paper 100 over sections on the patient's record where the doctor would like to enter the prescription information. In one embodiment, the doctor can line up the lines 104 on the prescription paper to the lines on the patient's record. The doctor can then write the prescription along the lines 104 on the front side 102 of the paper 100 and the information will be neatly transferred by the carbonized backing to the lines on the patient chart without the doctor having to recopy the information or attaching extraneous pieces of paper containing the information to the patient's file.

Advantageously, only the center portion of the prescription paper is coated with the carbonized backing so that a person can handle the paper by its edges without getting the hands dirtied by the carbon. In addition to carbonized backing, any other types of coating or image transfer system that is able to transfer the writing on the front side 102 of the prescription paper 100 to the surface underneath can be used without departing from the scope of the present invention. It can also be appreciated that the present invention is not limited to prescription pads for doctors as it can apply to note pads for doctors, dentists, psychiatrists and other individuals wherein the individual has to transfer the information given to a first person onto a record for the first person. For example, the paper can be used by health care providers to write down the names of over the counter medication that they are recommending to their patients.

Figure 3:
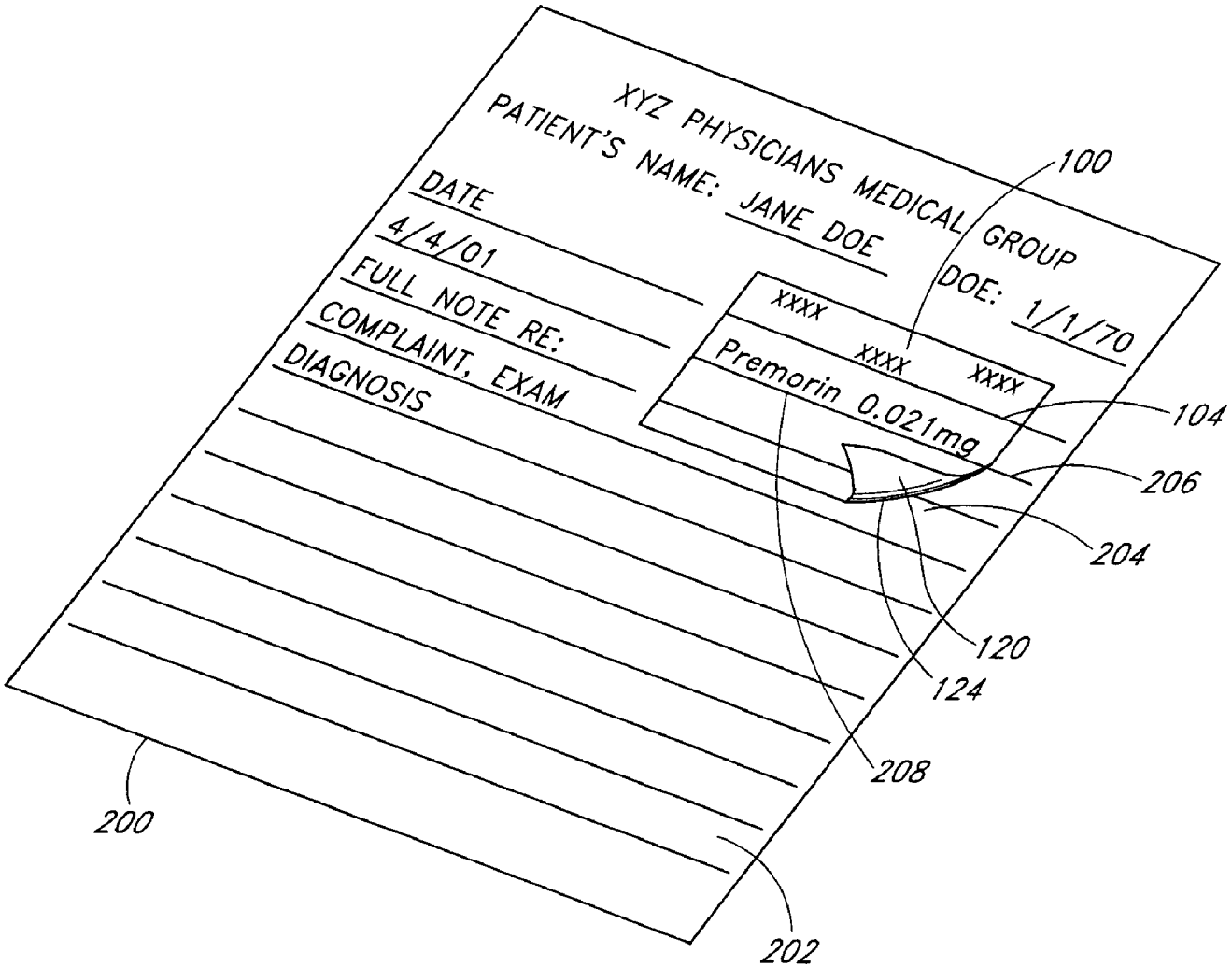
FIG. 3 illustrates the manner in which the prescription paper of FIG. 1 can be used in conjunction with a patient's chart.

FIG. 3 illustrates the manner in which the prescription paper 100 of one preferred embodiment can be used in conjunction with a patient's chart 200. As shown in FIG. 3, the prescription paper 100 can be placed on an upper surface 202 of the patient's chart 200 in a selected area 204 when entering prescription information. The doctor simply aligns lines 104 on the prescription paper 100 with lines 206 on the patient's chart 200 before writing the prescription information 208 on the prescription paper 100. Once the lines 104 on the prescription paper 100 are aligned with lines 206 on the patient's chart, the doctor then writes the prescription information and the information is transferred directly onto the patient's chart at the selected area 204 by the carbonized backing 124 on the back side 120 of the prescription paper 100. Since the space between the lines on the prescription paper is selected to match the space between the lines on the patient's chart, the prescription information can be neatly transferred onto the patient's chart. The area 204 on the patient's chart 200 that is selected for transferring the prescription information is preferably located adjacent to the doctor's notes and comments regarding the exam and diagnosis for the particular ailment or complaint that the prescription is intended to alleviate. For future visits, the doctor can easily review the patient's chart and determine the exact treatment and medication that was prescribed for past visits. Advantageously, the doctor does not have to spend time recopying the information onto the patient's chart or attaching copies of the prescription paper to the patient's chart and risk losing the copy. Furthermore, for future visits, the doctor does not have to waste time sorting through various loose pieces of copies of prescription paper in the patient's file to determine when each prescription was given.

Although the foregoing description of the preferred embodiment of the present invention has shown, described and pointed out the fundamental novel features of the invention, it will be understood that various omissions, substitutions, and changes in the form of the detail of the apparatus as illustrated as well as the uses thereof, may be made by those skilled in the art, without departing from the spirit of the invention. Consequently, the scope of the present invention should not be limited to the foregoing discussions, but should be defined by the appended claims.

What is claimed is:

1. A method of simultaneously writing prescription information on a sheet of paper and recording the information onto a medical record that is not attached to the sheet of paper, comprising:

providing a prescription paper that has a prescription writing area on an upper surface and a reproduction material on a lower surface, said reproduction material comprises a carbonized backing;

placing the prescription paper onto the medical record such that the lower surface of the prescription paper directly contacts an upper surface of the medical record, wherein placing the prescription paper onto the medical record further comprises placing the paper adjacent to an area containing examination and diagnosis information; and writing the information in an area on the upper surface of the prescription paper, wherein writing the information in the area results in said reproduction material simultaneously transferring the written information onto the medical record without requiring any surface treatment of the medical record to effectuate transfer of the written information.

2. The method of claim 1, wherein writing the information comprises writing information relating to an over-the-counter medication.

3. The method of claim 1, wherein providing a prescription paper that has a prescription writing area on an upper surface and a reproduction material on a lower surface comprises providing a notepad paper having a carbonized backing.

4. The method of claim 1, wherein providing a prescription paper that has a prescription writing area on an upper surface comprises providing a prescription paper having lines disposed at a pre-selected distance apart on the upper surface.

5. A method of simultaneously writing prescription information on a sheet of paper and recording the information onto a medical record that is not attached to the sheet of paper, comprising:

providing a prescription paper that has a prescription writing area on an upper surface and a reproduction material on a lower surface, said reproduction material comprises a carbonized backing;

placing the prescription paper onto the medical record such that the lower surface of the prescription paper directly contacts an upper surface of the medical record, wherein placing the prescription paper onto the medical record further comprises placing the paper adjacent to an area on the medical record containing a date which the prescription is given; and writing the information in an area on the upper surface of the prescription paper, wherein writing the information in the area results in said reproduction material simultaneously transferring the written information onto the medical record without requiring any surface treatment of the medical record to effectuate transfer of the written information.

6. The method of claim 5, wherein providing a prescription paper that has a prescription writing area on an upper surface of a reproduction material on a lower surface comprises providing a notepad paper with carbonized backing.

7. The method of claim 5, wherein providing a prescription paper that has a prescription writing area on an upper surface comprises providing a prescription paper having lines disposed at a pre-selected distance apart on the upper surface.

8. The method of claim 5, wherein writing the information comprises writing information relating to an over-the-counter medication.

* * * * *